US009950211B2

(12) United States Patent
Williams

(10) Patent No.: US 9,950,211 B2
(45) **Date of Patent: *Apr. 24, 2018**

(54) WEIGHT STACK PUSHUP EXERCISE DEVICE

(71) Applicant: Ronald Williams, Draper, UT (US)

(72) Inventor: Ronald Williams, Draper, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/345,324

(22) Filed: Nov. 7, 2016

(65) Prior Publication Data

US 2017/0050078 A1 Feb. 23, 2017

Related U.S. Application Data

(63) Continuation of application No. 14/918,438, filed on Oct. 20, 2015, now Pat. No. 9,486,668.

(Continued)

(51) Int. Cl.

| | |
|---|---|
| ***A63B 21/06*** | (2006.01) |
| ***A63B 23/12*** | (2006.01) |
| ***A63B 21/00*** | (2006.01) |
| ***A63B 21/04*** | (2006.01) |
| ***A63B 21/055*** | (2006.01) |
| ***A63B 21/062*** | (2006.01) |

(Continued)

(52) U.S. Cl.

CPC .... *A63B 23/1236* (2013.01); *A63B 21/00065* (2013.01); *A63B 21/0407* (2013.01); *A63B 21/055* (2013.01); *A63B 21/0552* (2013.01); *A63B 21/063* (2015.10); *A63B 21/068* (2013.01); *A63B 21/0628* (2015.10); *A63B 21/154* (2013.01); *A63B 21/156* (2013.01); *A63B 21/4034* (2015.10); *A63B 21/4035* (2015.10); *A63B 21/4045* (2015.10); *A63B 22/0002* (2013.01); *A63B 23/03533* (2013.01); *A63B 23/03541* (2013.01); *A63B 23/1245* (2013.01); *A63B 23/1254* (2013.01); *A63B 2071/009* (2013.01); *A63B 2225/09* (2013.01)

(58) Field of Classification Search

CPC ... A63B 21/06–21/0628; A63B 22/20–22/203; A63B 23/1236; A63B 23/1245; A63B 23/1254; A63B 23/03566; A63B 2022/0033; A63B 2022/0035

USPC ..... 482/141

See application file for complete search history.

(56) References Cited

U.S. PATENT DOCUMENTS 4,781,372 A * 11/1988 McCormack .... A63B 23/03533 482/104

6,186,930 B1 * 2/2001 Ignaczak ..... A63B 23/12 482/141

(Continued)

*Primary Examiner* — Gregory Winter

(74) *Attorney, Agent, or Firm* — David R. Conklin; Kirton McConkie

(57) ABSTRACT

An exercise machine is provided for developing the chest muscles while maintaining correct biomechanical posture and joint movement for the user, thereby maximizing efficiency and safety. The exercise machine includes a track on which two platforms independently slide. The platforms are each interconnected to a weight stack unit or other vertical resistance unit that provide resistance to the inward movement of the platforms. Each platform may also be connected to a tension element or resistance band that is configured to provide gradual and progressively increased resistance as the platforms are moved inwardly towards the center or center stop of the track.

17 Claims, 14 Drawing Sheets

Related U.S. Application Data

(60) Provisional application No. 62/066,828, filed on Oct. 21, 2014.

(51) Int. Cl.

| | |
|---|---|
| ***A63B 21/068*** | (2006.01) |
| ***A63B 23/035*** | (2006.01) |
| ***A63B 22/00*** | (2006.01) |
| *A63B 71/00* | (2006.01) |

(56) References Cited

U.S. PATENT DOCUMENTS

| | | | | |
|---|---|---|---|---|
| 7,134,987 | B2 * | 11/2006 | Goldstein | A63B 23/1209 482/141 |
| 7,654,942 | B1 * | 2/2010 | Batca | A63B 21/156 482/135 |
| 9,101,790 | B2 * | 8/2015 | Parnell | A63B 21/0442 |
| 9,440,105 | B1 * | 9/2016 | Lee | A63B 23/04 |
| 9,486,668 | B2 * | 11/2016 | Williams | A63B 21/0628 |
| 9,700,757 | B2 * | 7/2017 | Shade | A63B 23/1236 |
| 2006/0252614 | A1 * | 11/2006 | Rotondale | A63B 21/0628 482/100 |
| 2006/0264305 | A1 * | 11/2006 | Klassen | A63B 21/0628 482/99 |
| 2008/0090708 | A1 * | 4/2008 | Balaker | A63B 21/156 482/138 |
| 2009/0170668 | A1 * | 7/2009 | Giannelli | A63B 23/03533 482/94 |
| 2011/0021325 | A1 * | 1/2011 | Summers | A63B 21/0609 482/70 |
| 2012/0258843 | A1 * | 10/2012 | Summers | A63B 21/0603 482/93 |
| 2013/0035220 | A1 * | 2/2013 | Adams | A63B 21/04 482/129 |
| 2013/0337982 | A1 * | 12/2013 | Williams | A63B 21/02 482/122 |
| 2014/0141949 | A1 * | 5/2014 | Mills | A63B 23/1236 482/140 |

* cited by examiner

WEIGHT STACK PUSHUP EXERCISE DEVICE

RELATED APPLICATIONS

This application is a continuation of U.S. patent application Ser. No. 14/918,438, filed Oct. 20, 2015, which claims the benefit of U.S. Provisional Patent Application No. 62/066,828 which was filed on Oct. 21, 2014, which are incorporated herein in their entirety.

TECHNICAL FIELD

The present invention relates to exercise machines. More particularly, the present invention relates to an exercise machine that combines the motions of a pushup with a dumbbell fly with the user in a prone or pushup position. The exercise machine comprises various features to ensure proper biomechanical motion of the user thereby preventing injury and maximizing efficiency in muscular development. The exercise machine further comprises weight stacks which are configured to apply adjustable resistance to the motion of the user while using the exercise machine. The exercise machine further includes one or more resistance bands which are interposedly coupled between a stationary and a moving part of the exercise machine to provide dynamic resistance to the motion of the user while using the machine.

BACKGROUND

All skeletal muscles throughout the human body comprise an anatomical arc structure. See Faith and Fat Loss by Ron Williams, RTW Publishing International; First edition, 2009, incorporated herein in its entirety. This arc structure permits the muscle to contract and relax to achieve desired skeletal movements. The majority of muscles in the body are attached or anchored by ligaments and tendons to one or more stable skeletal bones and one or more mobile bones. The mobile bones are moved relative to the stable skeletal bones as the muscle is contracted and extended.

The chest muscles (i.e. pectoralis major and minor) are connected to the sternum, the clavicle, and the upper humerus, thereby forming an arc structure for these muscles. The chest muscles are contracted and extended to move the mobile, upper humerus bone with respect to the stable positions of the sternum and clavicle bones. The ball and socket anatomy of the shoulder joint comprises an extensive range of motion which permits medial and lateral rotation of the humerus. The chest muscles are contracted as the humerus adducts and rotates medially or internally towards the sternum. Conversely, the chest muscles are extended or relaxed as the humerus abducts and rotates laterally or outwardly away from the sternum. Based on this anatomy, maximum chest development is achieved when the chest muscles are optimally contracted and extended as part of a weight training activity. Maximum chest development is further achieved when weight training activities account for, and utilize the anatomical arc structure of the chest muscles.

Weight training or weight lifting is a common type of strength training for developing the strength and size of skeletal muscles. Weight training uses the weight force of gravity to oppose the force generated by muscle through concentric or eccentric contraction. Weight training uses a variety of specialized equipment to target specific muscle groups and types of movement.

Weight training may be performed using various types of equipment. In some instances, weight training is performed using free-weights. A free-weight can be classified as any object or device that can be moved freely in three-dimensional space. Examples of common free-weights include dumbbells, barbells, high/low or adjustable pulley systems, lat pull-down and low row devices, medicine balls, kettle bells, ankle weights, and the human body. In reality, any object that is free to move in three-dimensional space that is not fixed to any specific set of axis can be considered a free-weight.

Weight training may also be performed using an exercise machine. Unlike free-weights, an exercise machine is designed to limit the biomechanical motion of a portion of a user's body to one or two-dimensions. In this way, the exercise machine may focus the resistance and efforts of the user to an isolated muscle, or group of muscles.

Exercise machines use gravity, friction, tension, compression, and/or hydraulic forces to provide isolated resistance to the user. Exercise machines further provide optimized biomechanical movement and resistance for the user's body by incorporating various combinations of cables, cams, springs, elastomeric bands, hydraulic cylinders, levers, and pulleys into the machine's design. Exercise machine are thus specifically designed to provide exact, repeatable biomechanical motions that are calculated to optimize desired muscular development. In theory, any user that performs weight training on an exercise machine will achieve the muscular development for which the exercise machine was specifically designed.

Despite the general benefits of exercise machines, currently available devices have a number of shortcomings that result in less effective muscular development and potential joint and muscular injury to the user. For example, some exercise machines fail to consider and provide correct anatomical joint motion for the user. Some machines further fail to consider the structural anatomy of the targeted muscle group to optimally contract and extend the muscles for maximum efficiency and development.

As a specific example, some currently available exercise machines for developing the chest muscles fail to consider and address the correct anatomical joint motion of the shoulder and torso. This failure in design results in joint sheering as the user is required to apply or resist a force for which the targeted muscle group or the corresponding joints are not properly aligned. Joint sheering may cause tissue scaring, tearing of the muscle tissue, and/or injury to the joint, tendons, and ligaments. The resultant pain and inflammation associated with these types of injuries may result in decreased physical ability of the user, arthritis, and many other types of muscle and joint injuries. These types of injuries may also cause or exacerbate poor posture of the user. In response to the pain, the user is forced to compromise their form and body position thereby reducing the effectiveness of the exercise, and potentially leading to additional and/or long-term injuries.

Some machines further fail to reduce or correct ballistic movements and stresses that are experienced by the user when using an exercise machine. Ballistic movement and stresses on weight stack machines occur as the user utilized inappropriate or uncontrolled movements while using the machine. This may be caused by lack of proper knowledge in using the machine, incorrect selection of weight, or excess resistance. Ballistic stresses create non-fluid movement for the user and machine which may lead to muscular stresses and damage. The non-fluid movements present an undesirable feeling or sensation for the usability of the machine which may lead the user to avoid use thereof.

Thus, while exercise machines for developing the skeletal muscles are available, challenges still exist. Accordingly, there is a need in the art for an improved exercise machine that overcomes the current challenges. Such a device is disclosed herein.

BRIEF SUMMARY OF THE INVENTION

The present invention relates to exercise machines. More particularly, the present invention relates to an exercise machine that combines the motions of a pushup with a dumbbell fly with the user in a prone or pushup position. The exercise machine comprises various features to ensure proper biomechanical motion of the user thereby preventing injury and maximizing efficiency in muscular development. The exercise machine further comprises a weight stack component that applies resistive force to the movement of the machine. The exercise may further comprise one or more resistance bands that are interposedly coupled between a stationary surface and a moving surface of the machine to apply a dynamic resistive force to the movement of the machine.

Some implementations of the present invention include an exercise machine that combines the motions of a pushup with a dumbbell fly to develop the user's chest muscles. In some instances, the exercise machine is used from a prone or pushup position, whereby the exercise machine is placed on the floor at a position generally beneath the user's chest. The exercise machine comprises a track or rail on which is slidably mounted a pair of platforms, each platform comprising a handle. The platforms are securely coupled to the track, wherein the platforms and handles are incapable of being removed from the track during normal use of the machine. The track is oriented beneath the user such that the platforms move laterally and medially along the track relative to the median sagittal plane of the user's body when in use. In some instances, the track further includes a central bridge or stop which divides the track into a right half and a left half. The track may further include right and left stops which limit the outward motions of the platforms.

Some implementations of the present invention further comprise one or more tension elements or resistance bands that increase the resistance of the medial and/or proximal sliding motions of the left and right handles within their respective sides. In some instances, the tension element comprises an elastomeric band having a first end that is attached to the platform or handle, and a second end that is attached to a stationary portion of the machine. For example, in some instances the second end of the tension element is coupled to a frame portion or surface of the machine. In these instances, the resistance of the medial motion is dynamically increased as tension is applied to the tension element by sliding the platform medially.

In some instances, the distance between the handles and platforms is adjustable by the user. Thus, a user may adjust the positions of the handles and platforms to achieve an optimal width for the user's body. In some instances, the position of the platforms is selected to achieve a power position for the user, wherein the user's humorous and forearm form a 90° angle when the user's upper body is lowered to a "down" pushup position. This power position provides anatomically and biomechanically correct motion of the user's shoulder joint throughout the user's motion on the exercise machine, thereby maximizing the efficiency and safety of the exercise for the user.

Some implementations of the present invention further comprise an exercise machine having a first platform that slides medially and laterally independent of the medial and lateral sliding motions of a second platform. As such, the user's independent movement of each platform isolates the effectiveness of the exercise to the user's left and right muscle groups, respectively. This feature further prevents the user from relying predominantly on their dominant side to complete the exercise.

Some implementations of the present invention further comprise one or more weight stack units having a plurality of weights selectively coupled to a cable and further connected to the first and second platforms via the cable, wherein the weight stack units apply increased resistive force to the platforms during use of the device. The weight stack units are configured to permit a user to selectively apply a desired amount of resistive force to the platforms by selectively inserting a weight pin into a selector shaft of the weight stack units, wherein the position of the weight pin determines the number of weight stack plates that are coupled to the motion of the platforms via a system of pulleys and cables. In some instances, a first weight stack unit is coupled to the first platform and handle via a first cable and set of pulleys, and a second weight stack unit is coupled to the second platform and handle via a second cable and a set of pulleys.

In some instances, the present invention further includes a method for maximizing the efficiency and safety of muscle development while using the exercise machine disclosed herein. For example, in some instances a method is provided having a first step for adjusting the position of the first and second platforms to set a maximum distance between the handles, wherein the maximum distance between the handles is equal to a distance between the creases of the user's elbows when the user is in the prone position (power position) and the elbows are bent to approximately 90°. The method further includes a step for adjusting the weight pin on each weight stack to select a desired amount of weight. The method further includes a step for grasping the handles. The user then bends their elbows to lower their chest towards the exercise machine, opening the chest and pulling the shoulders back until they achieve a full stretch. The user then extends their arms, thereby raising their chest back to the starting position. The user then concaves the chest fully extending the arms, adducting and rotating their humeri medially while maintaining the starting position. With the user's arms fully extended and the chest concaved, with the humeri adducted and rotated medially, the user then slides the left and right handles medially or inward towards the middle bridge. The user then returns the handles to the maximum distance position while abducting and rotating the user's humeri laterally, thereby returning the user to the starting position. The method may further include a step for securing a tension element to one or more platforms and a stationary surface of the machine.

In other instances, the exercise machine of the present invention may be oriented and positioned by the user to provide resistance weight training to the user's abdomen, deltoids, inner thighs, outer thighs, biceps, and triceps.

DESCRIPTION OF THE DRAWINGS

It will be appreciated by those of ordinary skill in the art that the various drawings are for illustrative purposes only. The nature of the present invention, as well as other embodiments of the present invention, may be more clearly understood by reference to the following detailed description of the invention, to the appended claims, and to the several drawings.

DETAILED DESCRIPTION

Figure 1:
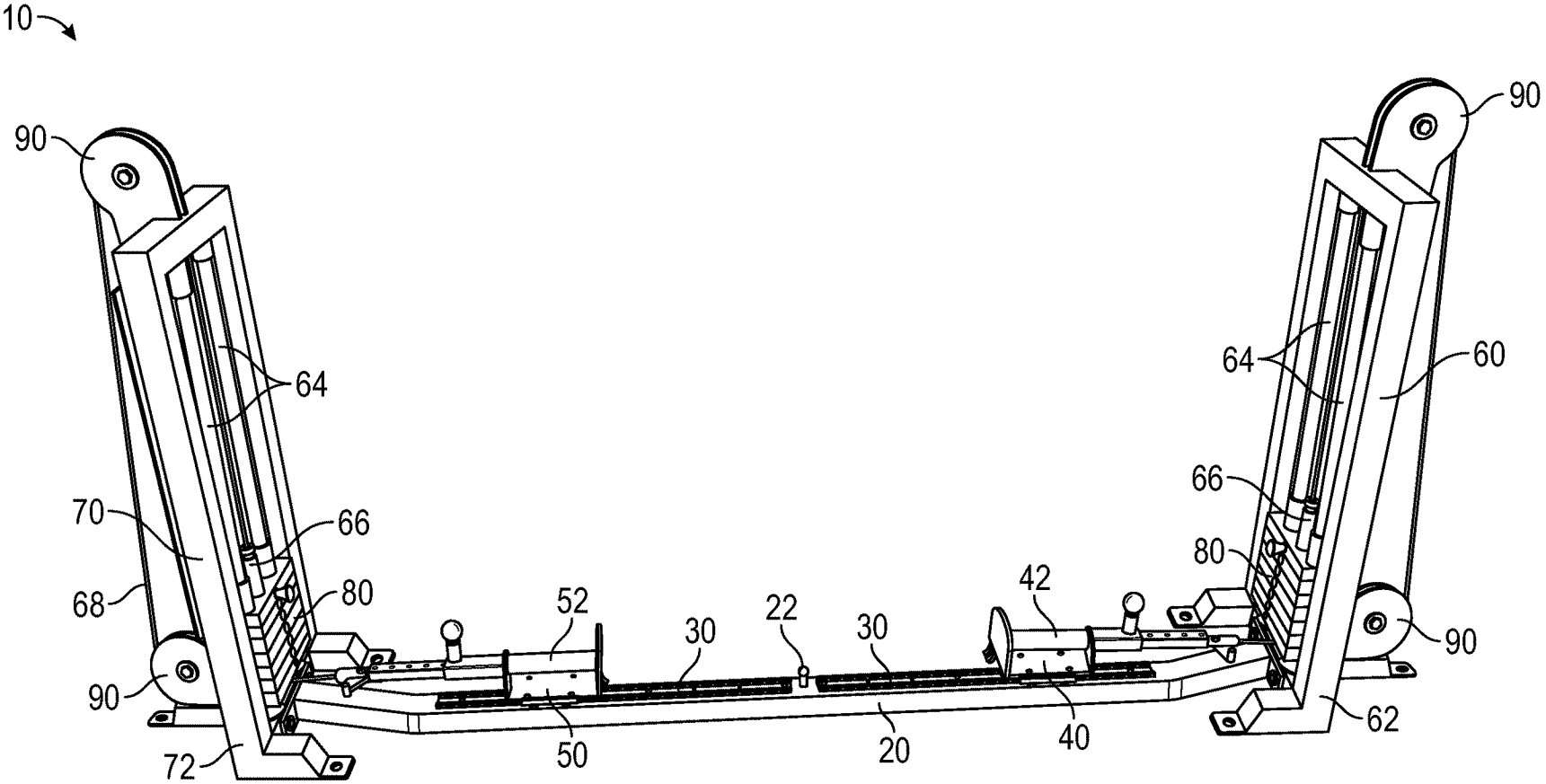
FIG. 1 is a perspective view of a weight stack pushup exercise machine in accordance with a representative embodiment of the present invention.

The present invention relates to exercise machines. More particularly, the present invention relates to an exercise machine that combines the motions of a pushup with a dumbbell fly with the user in a prone or pushup position. The exercise machine comprises various features to ensure proper biomechanical motion of the user thereby preventing injury and maximizing efficiency in muscular development. The exercise machine further comprises weight stacks which are configured to apply adjustable resistance to the motion of the user while using the exercise machine. The exercise machine further includes one or more resistance bands which are interposedly coupled between a stationary and a moving part of the exercise machine to provide dynamic resistance to the motion of the user while using the machine.

The present disclosure further relates to apparatuses, systems, and methods related to exercising the muscles of the chest, shoulder and triceps. It will be appreciated by those skilled in the art that the embodiments herein described, while illustrating certain embodiments, are not intended to so limit this disclosure or the scope of the appended claims. Those skilled in the art will also understand that various combinations or modifications of the embodiments presented herein can be made without departing from the scope of this disclosure.

Definitions

As used herein, the term "arc structure" is understood to describe the anatomical structure of skeletal muscles within the human body. In particular, arc structure describes the orientation of muscle tissue in the body which results from a portion of the muscle being attached to a stable bone, and another portion of the muscle being attached to a mobile bone. Maximum muscle development is achieved when resistance to and movement of a muscle group utilizes the arc structure of that muscle group.

As used herein, the term "biomechanically correct" is understood to describe a condition or motion where the natural, anatomical movement of the muscles, joints, arc structure, bone structure, and posture of the user is maintained during the fulfillment of an exercise.

As used herein, the terms "prone position" or "pushup position" are understood to describe a position of the user's body when using an exercise machine disclosed herein, wherein the user's body is supported above the ground in a generally horizontal position by the user's hands and toes which are in contact with the ground. These terms may also describe a position of the user's body wherein the user's body is supported above the ground in a generally horizontal position by the user's hands and knees which are in contact with the ground.

Some embodiments of the present invention provide an exercise machine configured to combine several exercise movements into a single device. In particular, some exercise machines of the present invention combine the movements of a bench press, dumbbell press, cable crossovers, flyes, Pec Deck, and pushups into a single device. The exercise machines of the present invention further provide various adjustable components whereby the user may fit the machine to their individual anatomy, thereby achieving biomechanically correct movement and resistance to their isolated muscle groups. Thus, embodiments in accordance with the present disclosure are biomechanically correct to facilitate maximum development, comfort, safety, and enjoyment for the user.

Some embodiments in accordance with the present disclosure provide an exercise machine that is safe for use. Specifically, some exercise machines of the present invention provide resistance or workload that is consistent, gradual, and progressive, thereby allowing the body to adapt as it moves through the range of motion. The gradual increase of tension eliminates jerky and ballistic movements which may result in injury. Also, the resistance provided by the exercise machine is applied equally and independently to both sides of the user's body. As such, each side of the user's body is required to carry its own workload, thus increasing the effectiveness of workout and muscle development.

Some embodiments in accordance with the present disclosure further provide an exercise machine that maximizes effectiveness to the user. Some designs of the present invention provide full range of motion for the user, whereby both arms of the user are required to push or pull against a resistance, thereby optimally contracting the muscles of the chest, shoulders, and triceps. The exercise machine further provides biomechanically correct posture to the user throughout the user's movements on the machine. In some instances, the exercise machine is configured to flow with the structures of the user's body without creating discomfort or awkward movements. The exercise machine is thus configured to accommodate the joint structure, joint motion, muscular arc structure, and posture of the user to maximize efficiency and comfort.

The embodiments of the present invention are further designed to eliminate friction in each movement of the exercise machine. Thus, the present invention provides the user with smooth and comfortable transitions in the movements of the machine. Further, the exercise machines of the present invention comprise a simple construction and layout that is easily and readily understood by the user. Thus, a user may easily and accurately perform exercise movements on the machine and achieve the desired results.

The embodiments of the present invention further include a weight stack unit that permits a user to select a weight amount that is applied to the movement of the machine during use. The weight stack unit includes a plurality of weight stack plates that may be selectively applied to the motion of the handle and platform assemblies to increase resistive force throughout the motion of the machine.

The embodiments of the present invention further include tension elements or resistance bands to reduce or correct ballistic movements and stresses that may otherwise be experienced by the user during use of the machine. The resistance bands provide dynamic, increasing resistance throughout the movement of the machine. Weight stack machines are typically designed so that the active or moving weight stack plates are maximally distanced from the stationary weight stack plates when the user achieve the maximum motion or position of the machine (i.e., for a bench press machine, this maximum motion or position would be achieved when the user's elbows are maximally extended). For a typical weight stack machine (and free-weights, for that matter) the maximum "effective resistance" experienced by the user occurs at the beginning of the motion and gradually reduces as the user achieves the maximum motion or position. This is due to the biomechanical physiology of the body's musculoskeletal configuration. In contrast, the "effective resistance" of the resistance bands increases as the user advances from the beginning to the maximum motion or position. Thus, the inclusion of the resistance bands with the weight stack plates ensures that a maximum "effective resistance" is experienced by the user throughout the entire motion of the machine (i.e., as the "effective resistance" of the weight stack plates decreases, the "effective resistance" of the resistance bands increases).

Figure 2:
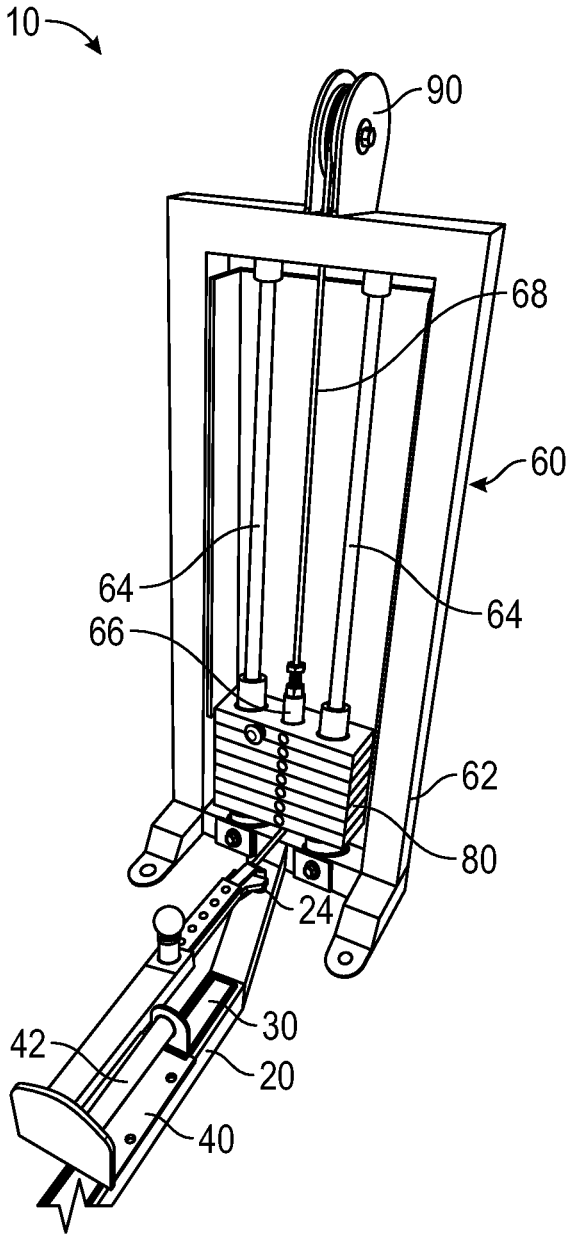
FIG. 2 is a perspective view of the weight stack unit of the weight stack pushup exercise machine of FIG. 1 in accordance with a representative embodiment of the present invention.
Figure 3:
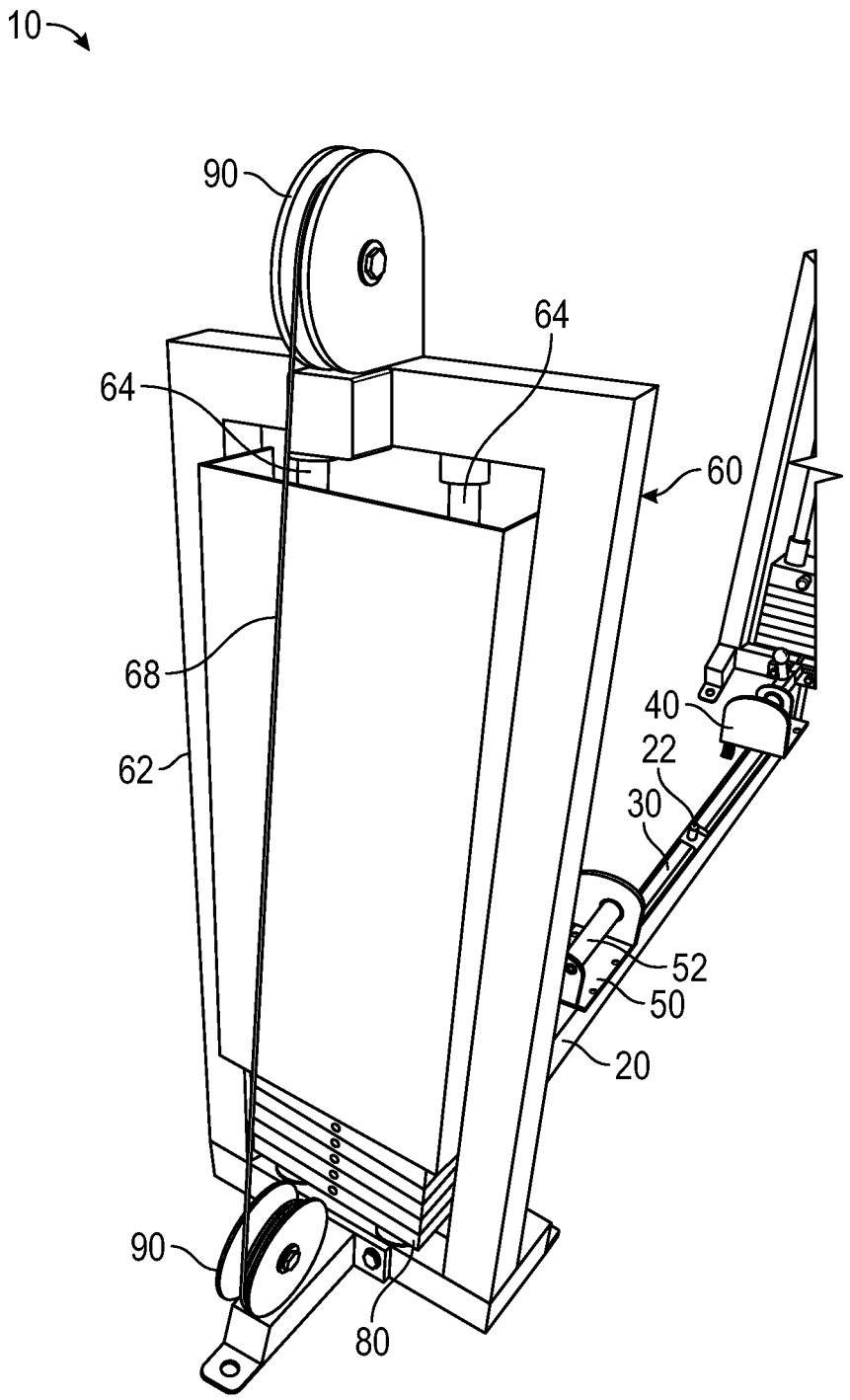
FIG. 3 is a perspective end view of the weight stack unit of the weight stack pushup exercise machine of FIG. 1 showing the pulley system in accordance with a representative embodiment of the present invention.

Referring now to FIGS. 1-3, a weight stack pushup exercise machine 10 is shown. Exercise machine 10 comprises a cross-member 20 on which is mounted a track 30 for slidably receiving and maintaining first and second platforms 40 and 50, respectively. In some instances, platforms 40 and 50 are secured to track 30 via a ball bearing interface 600. In some embodiments, platforms 40 and 50 are irremovably secured to track 30, wherein platforms 40 and 50 are incapable of being removed from track 30 during normal use of the machine 10. Cross-member 20 further comprises a center stop 22 to limit the maximum inward motions of platforms 40 and 50. Cross-member 20 further comprises outer stops 24 to set and maintain a starting position for platforms 40 and 50.

Exercise machine 10 further comprises a first weight stack unit 60 and a second weight stack unit 70 coupled to first and second distal or outer ends of cross-member 20. Weight stack units 60 and 70 each comprise a frame 62 and 72 having sufficient structural integrity to support a plurality of weight stack plates 80. Weight stack plates 80 slide upwardly and downwardly within frames 62 and 72 along guide rods 64 via a selector shaft 66, cable 68, and system of pulleys 90, as is commonly utilized in weight stack machines and as shown in FIGS. 1-3.

In some embodiments, platforms 40 and 50 further comprise a handle 42 and 52 which are configured to support a user's palm. Handles 42 and 52 are fixedly coupled to platforms 40 and 50, respectively, such that a user may slidably change the position of platforms 40 and 50 along track 30 by gripping and laterally moving handles 42 and 52. Handles 42 and 52 may be fixed in position where a central axis of the handle is parallel to track 30, as shown, or in a position where the central axis is perpendicular to track 30. In some embodiments, handles 42 and 52 are rotationally coupled to platforms 40 and 50. In some instances, handles 42 and 52 may be fixed in any desired position of axial rotation relative to platforms 40 and 50, respectively.

Figure 4:
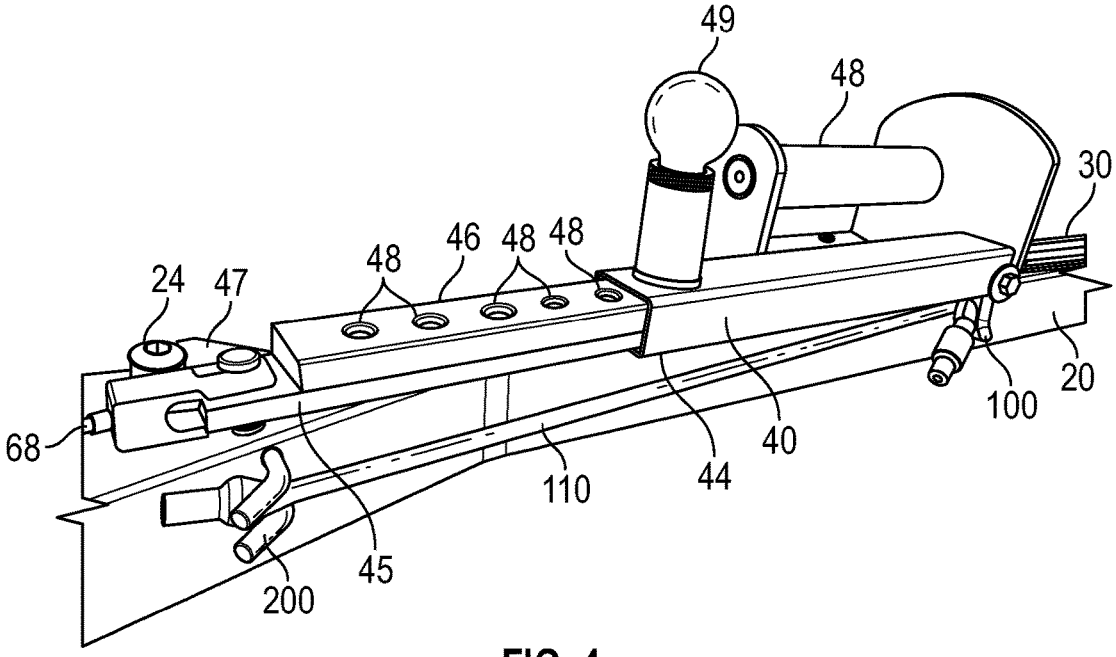
FIG. 4 is a detailed, perspective side view of the handle and platform assembly of the weight stack pushup exercise machine of FIG. 1 shown in a starting position in accordance with a representative embodiment of the present invention.
Figure 5:
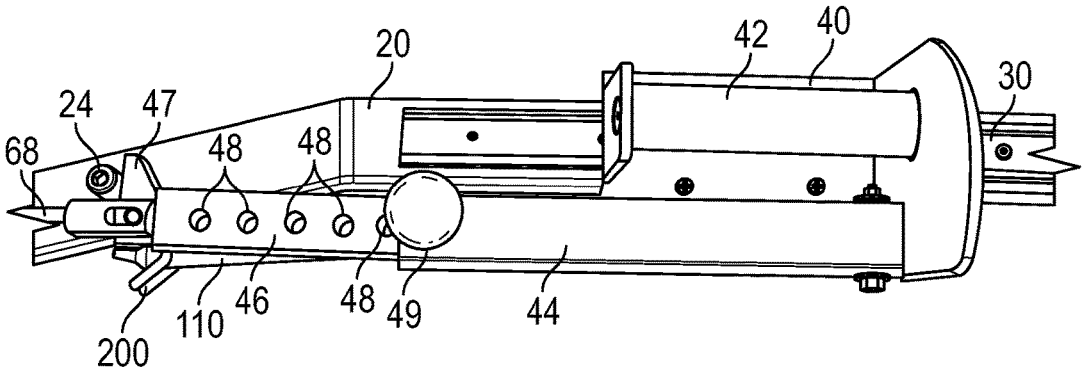
FIG. 5 is a detailed, perspective side view of the handle and platform assembly of the weight stack pushup exercise machine of FIG. 1 shown in a starting position in accordance with a representative embodiment of the present invention.
Figure 6:
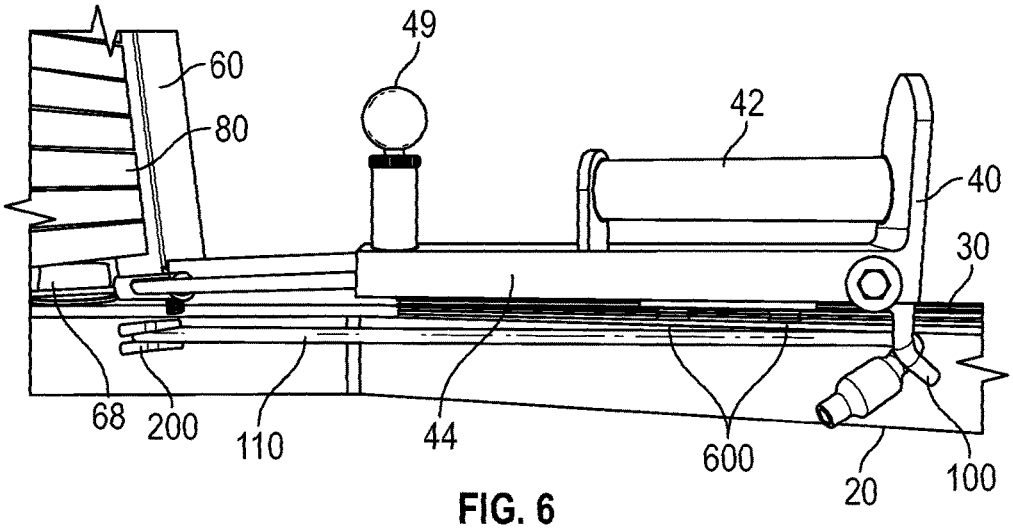
FIG. 6 is a detailed, perspective bottom and side view of the handle and platform assembly of the weight stack pushup exercise machine of FIG. 1 shown in a starting position in accordance with a representative embodiment of the present invention.

Referring now to FIGS. 4-6, platform assembly 40 comprises a housing 44 having a channel into which an adjustment plate 46 is slidably and selectively inserted. In some embodiments, adjustment plate 46 comprises a plurality of adjustment holes 48 that are aligned with a spring-loaded selector pin 49 forming a portion of housing 44. Adjustment plate 46 may be slid within the channel of housing 44 to select a desired position of handle 42 with respect to center stop 22. Accordingly, the adjustability of adjustment plate 46, adjustment holes 48 and selector pin 49 permit the user to select a maximum distance between the handles.

Adjustment plate 46 further comprises a distal end 45 having an aperture for receiving a terminal end of cable 68. Distal end 45 further comprises a catch 47 that extends outwardly from a side profile of adjustment plate 46 so as to contact outer stop 24, thus limiting the movement of platform 40 in the outward direction.

Figure 7:
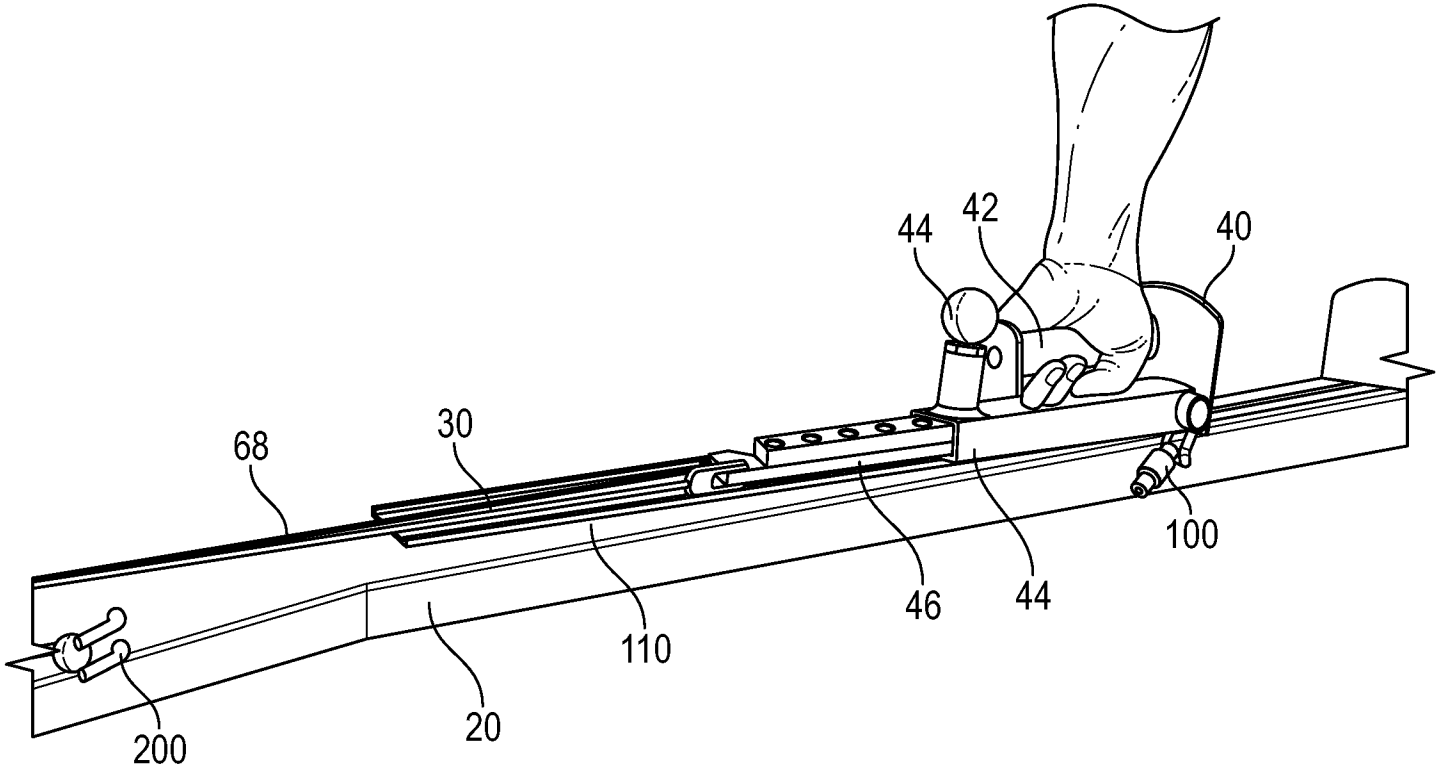
FIG. 7 is a perspective side view of the handle and platform assembly of the weight stack pushup exercise machine of FIG. 1 shown in a maximally contracted position in accordance with a representative embodiment of the present invention.
Figure 8:
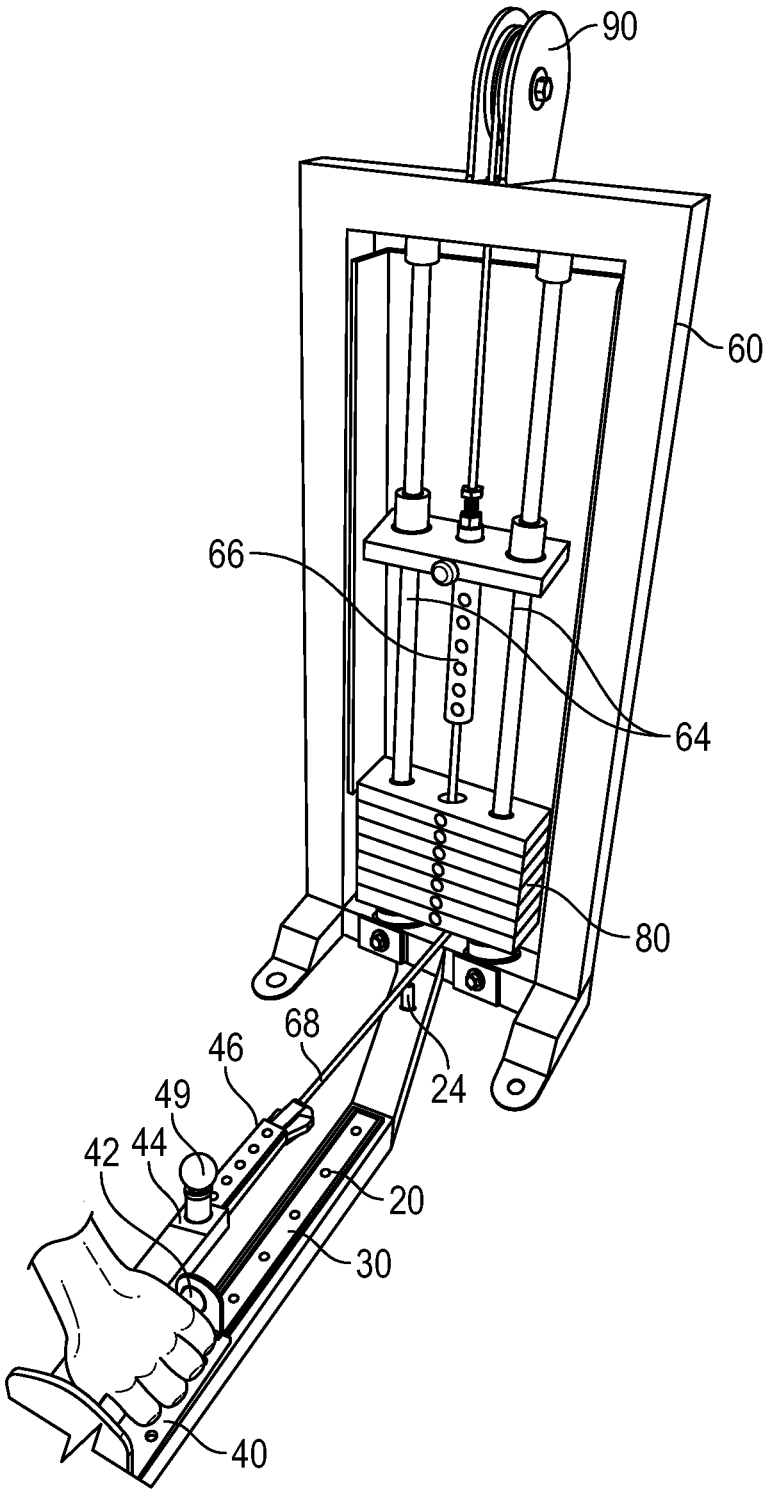
FIG. 8 is a perspective view of the weight stack unit of the weight stack pushup exercise machine of FIG. 1 showing the handle and platform assembly in a maximally extended position in accordance with a representative embodiment of the present invention.

In some embodiments, platform 40 further comprises a first mount 100 for receiving a first terminal end of a tension element or resistance band 110. Cross-member 20 further comprises a second mount 200 for receiving a second terminal end of resistance band 110. Resistance band 110 applies tension between platform 40 and cross-member 20, wherein the tension force is transferred to cable 68 and the user, as platform 40 is slid inwardly towards center stop 22, as shown in FIGS. 7 and 8.

Figure 10:
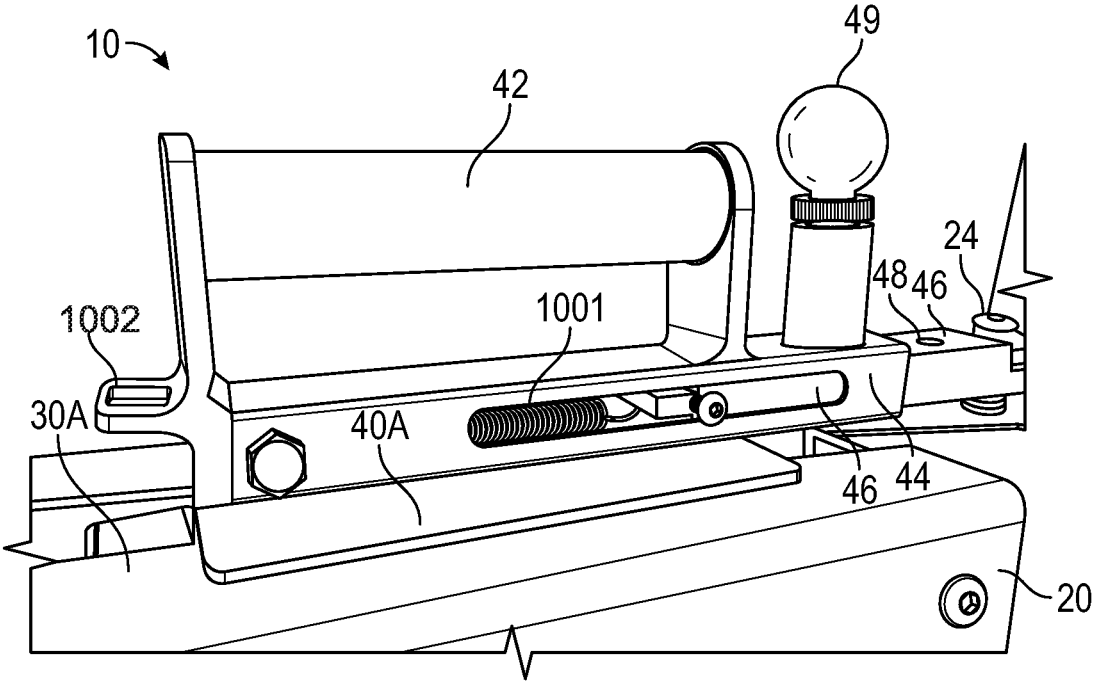
FIGS. 10-12 provide detailed perspective views which illustrate alternate configurations of various components of the weight stack exercise machine of FIG. 1.
Figure 11:
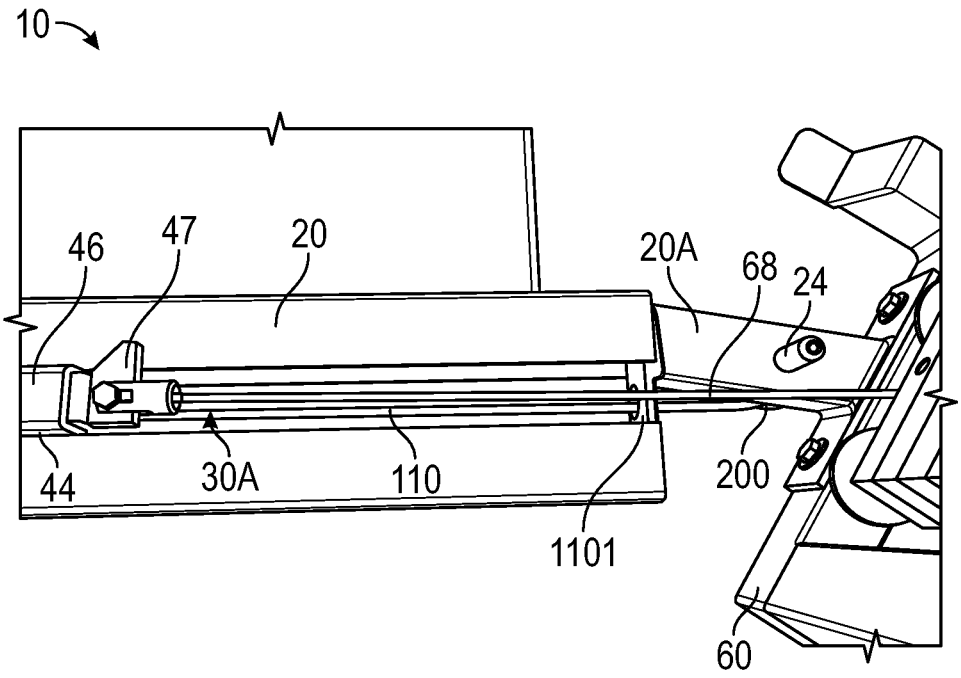
Figure 12:
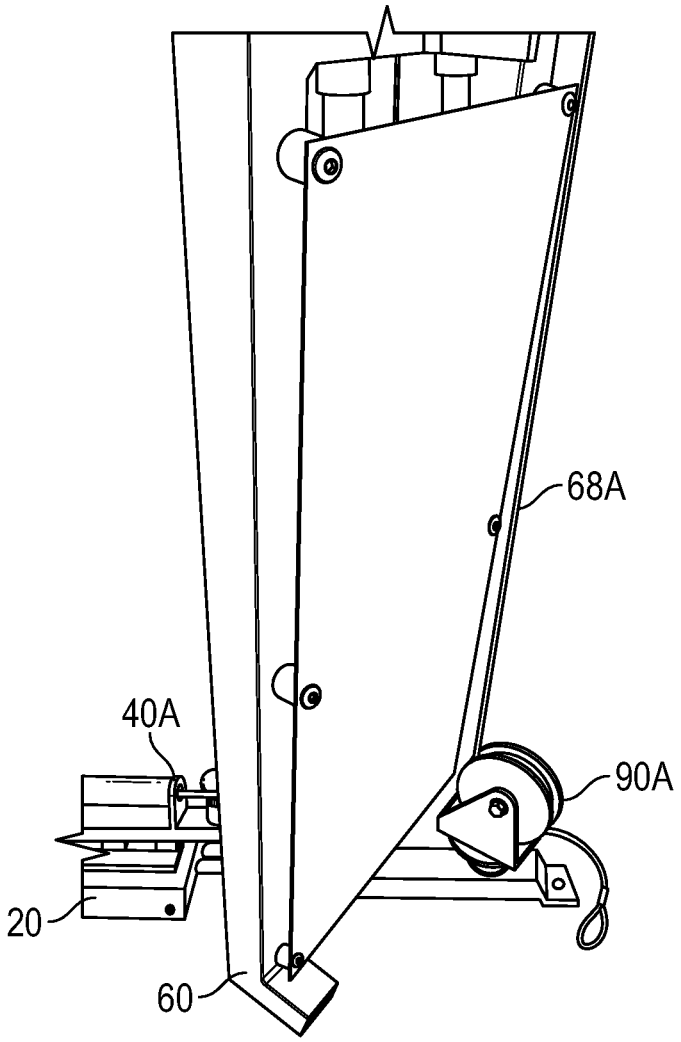

FIGS. 10-12 illustrate alternate configurations of various components of exercise machine 10. These alternate configurations can be used in conjunction with the other components of exercise machine 10 as described above. In some embodiments, as shown in FIGS. 10 and 11, cross-member 20 may include a channel 30A rather than tracks 30 within which the platforms slide. For example, as shown in FIG. 10, a platform 40A can be configured with suitable sliding components (not visible) which are slidably contained within channel 30A. In such embodiments, platform 40A can slide in channel 30A in the same manner as platform 40 slides along channel 30 as described above.

One benefit of employing channel 30A is that it allows resistance band 110 to be positioned within cross-member 20 as shown in FIG. 11. In particular, the ends of cross-member 20 can include an opening 1101 through which resistance band 110 can extend. One end of resistance band 110 can be anchored within second mount 200, which may be an opening in cross-member extension 20A as shown in FIG. 11, while the other end of resistance band 110 may be anchored to first mount 100 formed on a portion of platform 40A that is positioned within channel 30A. As shown in FIG.

11, cross-member extension 20A can be angled from cross-member 20 so that second mount 200 is aligned with the center of cross-member 20. In this way, resistance band 110 can run parallel with and be centered below platform 40A.

Housing 44 of platform 40A is shown as containing a spring 1001 that is coupled to the end of adjustment plate 46. Spring 1001 provides a biasing force to assist in adjusting the position of housing 44 along adjustment plate 46. In the orientation depicted in FIG. 10, spring 1001 would provide a pulling force on housing 44 to bias it in a rightward direction. This pulling force would make it easier to adjust platform 40A in a wider position, or, in other words, spring 1101 facilitates sliding housing 44 further overtop adjustment plate 46.

Platform 40A also includes a loop 1002 on the inside end of the platform. Loop 1002 can be used to connect a separate handle or other structure to platform 40A to facilitate performing bicep curls, triceps extensions, or other similar exercises on exercise machine 10. Also, in platform 40A, handle 42, housing 44, and adjustment plate 46 are aligned unlike in platform 40 where housing 44 and adjustment plate 46 are offset from handle 42.

As shown in FIGS. 11 and 12, in some embodiments, weight stack units 60 can be positioned at a non-ninety-degree angle from cross-member 20. For example, weight stack units 60 can be angled so that the weight stack units face towards the user's body while the user is performing the exercise.

FIG. 12 also illustrates that a pulley 90A positioned at the bottom of weight stack unit 60 can be configured to swivel. Also, cable 68 can be divided into two separable portions. A first portion 68A can be coupled to weight stack plates 80, while the second portion (not visible) can be coupled to platform 40A. The ends of these portions of cable 68 can be configured to selectively couple together (e.g., via a loop on one end and a carabiner on the other end). In this way, portion 68A can be detached to allow a handle or other structure to be attached to portion 68A. A user could then employ the handle to perform various exercises using weight stack unit 60 for resistance.

Referring now to FIGS. 9A-9D, a method for maximizing the efficiency and safety of muscle development is shown. This method may be followed when using exercise device 10. Alternatively, this method may be provided as instruction when teaching a user how to properly use exercise device 10.

Figure 9A:
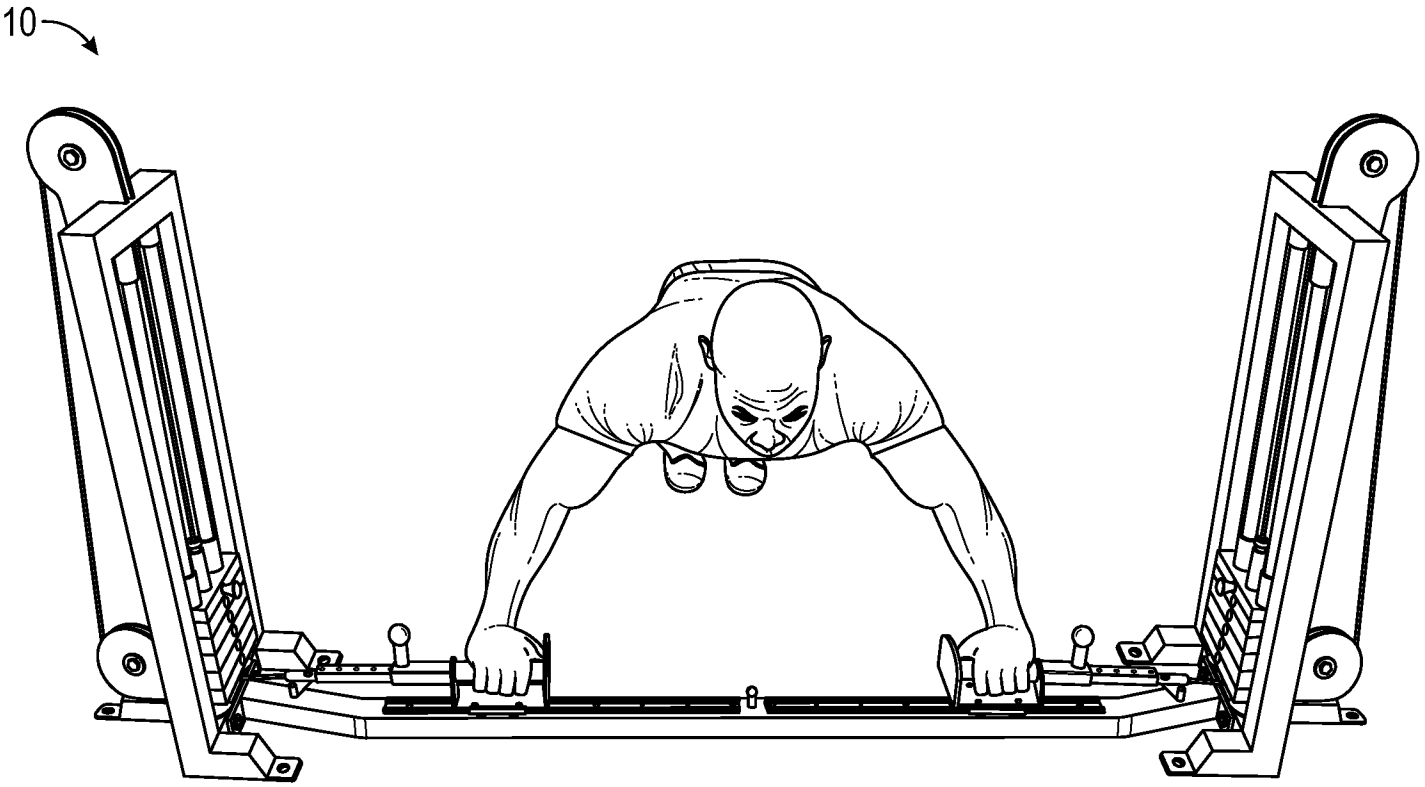
FIGS. 9A-9D demonstrate the proper use of the weight stack pushup exercise machine of FIG. 1 through various perspective front views in accordance with a representative embodiment of the present invention.
Figure 9B:
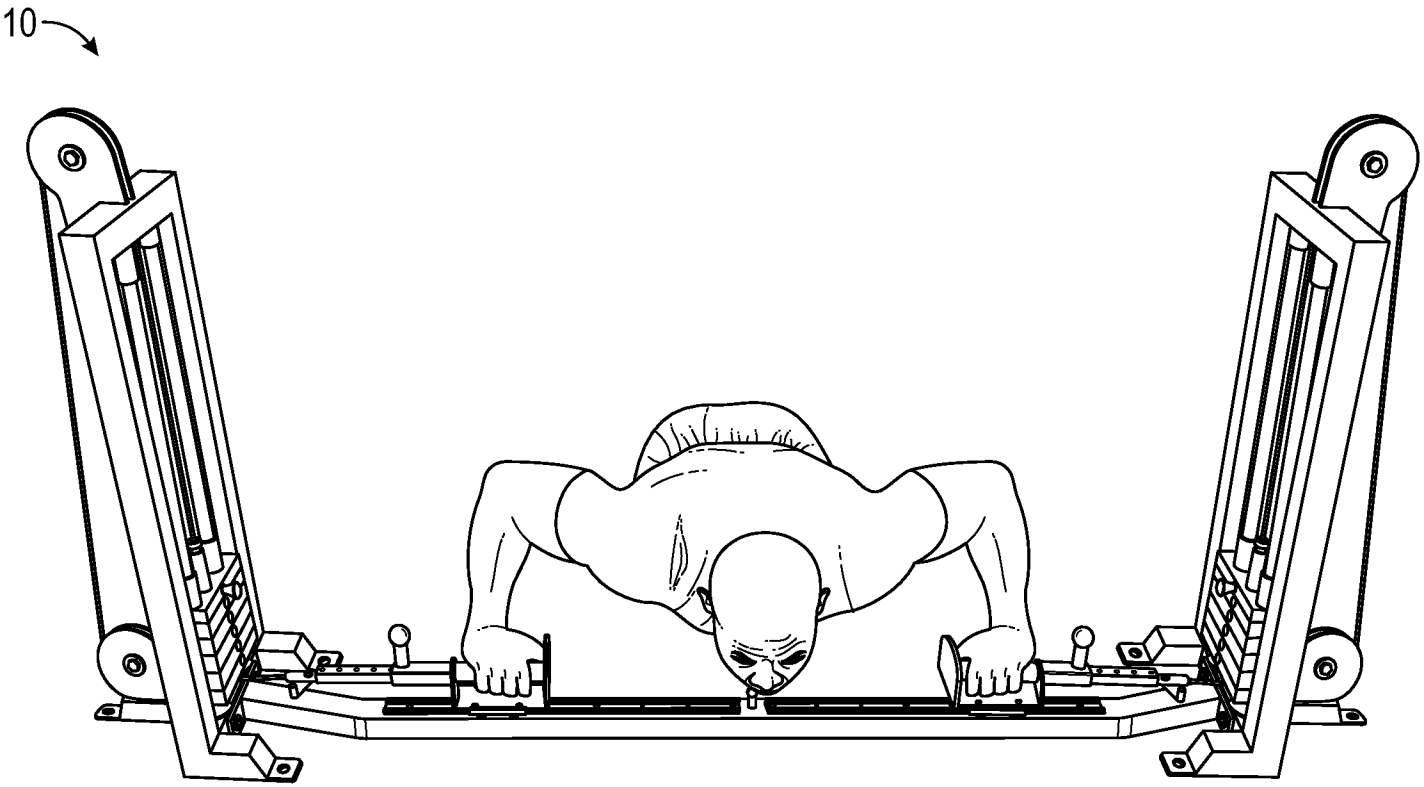
Figure 9C:
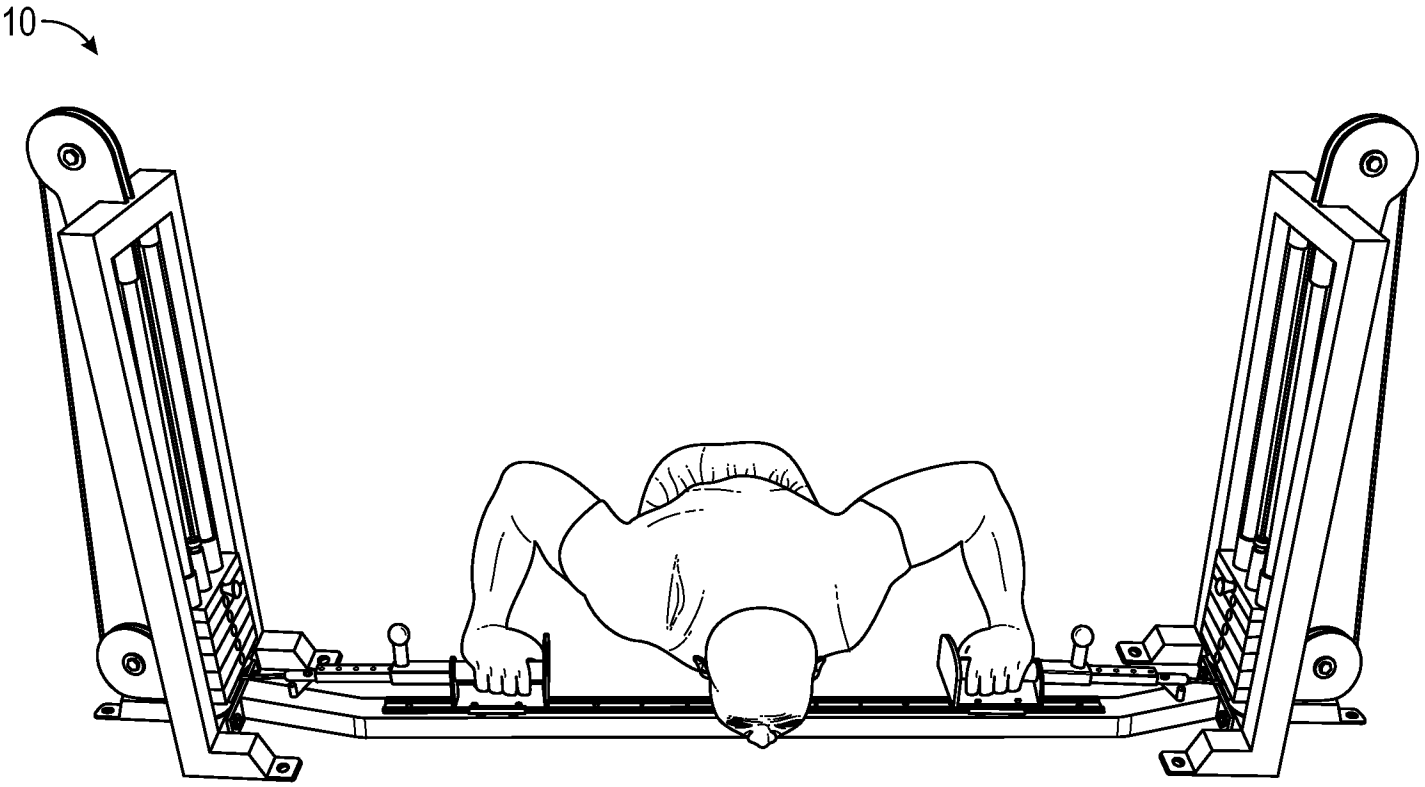

In some embodiments, a method for maximizing the efficiency and safety of muscle development includes a first step of adjusting the distance between platforms 40 and 50 by adjusting and securing the positions of adjustment plates 46 within housing 44 via selector pin 49. This step sets the machine to provide a personal power position for the user. This step may further include a sub-step for determining the correct maximum distance by measuring the distance between the user's elbow creases when bent to approximately 90° while in the prone position, as shown in FIG. 9A. The user then grasps the handles of the exercise machine while in the prone position, with their elbows fully extended and the handles separated at the maximum distance, as shown in FIG. 9C. This may be referred to as the starting position. The user then bends their elbows to lower their chest towards the center stop 22 of the machine to a maximum depth, as shown in FIG. 9B. As the user lowers their chest, the user's humeri are abducted and rotated laterally, thereby opening their chest to achieve a full stretch. The user then extends their arms, thereby straightening their elbows and returning to the starting position, as shown in FIG. 9A.

Figure 9D:
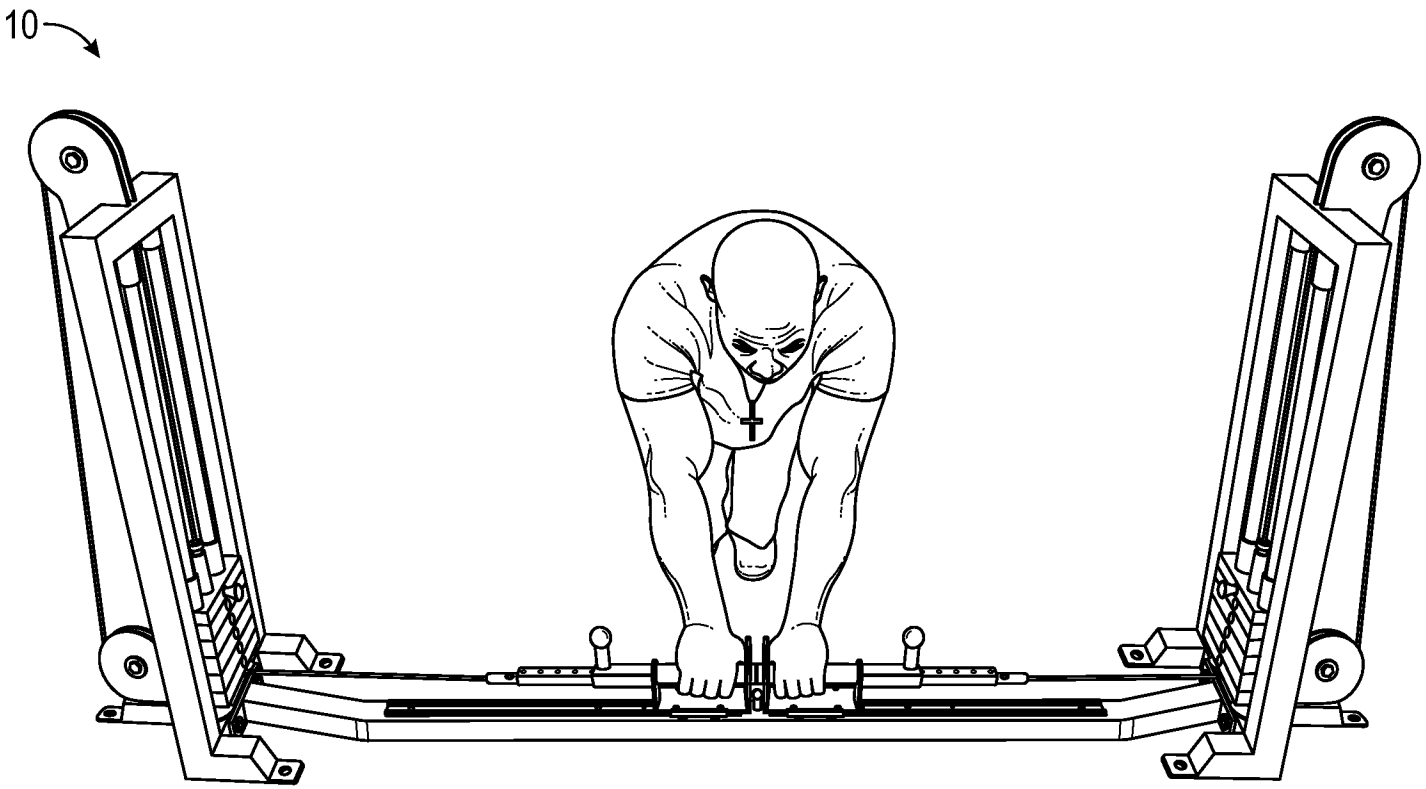

At this point the user adducts and rotates their humeri medially while maintaining the starting position. While holding the adducted and rotated position of the humeri, the user slides the handles medially inward towards the center stop 22, as shown in FIG. 9D. The user then returns the handles to the maximum distance while simultaneously abducting and rotating their humeri laterally, or the starting position shown in FIG. 9A. The motions shown in FIG. 9 may be referred to as one complete repetition.

When performing the steps of the method shown in FIG. 9, the various positions and movements are performed as a single, continuous motion. The exercise takes place in two directions, namely, vertical and horizontal directions. Thus, the exercise according to the method shown in FIG. 9 may be described as having two vectors which creates two motions or two types of resistance in one positive fluid movement. The first or vertical movement is much like a pushup, wherein the user's arms are straight with the user's hands gripping the handles. The forearms should be generally parallel to one another during the vertical movement, i.e. the user's elbows should not go inside or outside of this position. The forearms should also be generally perpendicular or normal to the plane of the floor or surface on which the exercise machine is supported. At the top of the movement, or the starting position, the arms are fully extended. When the humeri are adducted and rotated medially, the chest should concave slightly.

The second or horizontal movement involves the hands being brought together by sliding the handles inwardly towards the middle bridge. The arms are then returned to the starting position, thereby completing the repetition.

As user gains increased strength during the course of an exercise program, the resistance of exercise machine 10 may be gradually increased to continue to provide an effective exercise for the user. Additional resistance may be provided by selecting weight stack plates using the weight stack pin. Dynamic resistance may be added by the use of one or more tensioning elements or resistance bands 110 which are placed into first and second mounts 100 and 200, as described above. Dependent upon the skill of the user, the exercise may be completed while being supported either on the knees or the toes. For the novice user, the exercise is completed with the user's knees in contact with the floor and in close proximity to the exercise machine. Increased resistance is achieved as the user increases the distance between their knees and the exercise machine.

For the advanced user, the exercise is completed with the user's body being supported solely by the user's hands and toes. Elastomeric bands or straps may further be placed across the back of the user to increase resistance during the first or vertical movement shown in FIGS. 9A and 9B. For example, in some instances a middle portion of an elastomeric band or strap is positioned across the back of the user while each end of the strap is further secured to the exercise machine. In other instances, the middle portion of the elastomeric band or strap is positioned across the back of the user while each end of the strap is held by the user with the handle. Thus, as the user raises the body during the vertical movement, the additional elastomeric straps provide increased resistance to the movement.

Figure 9E:
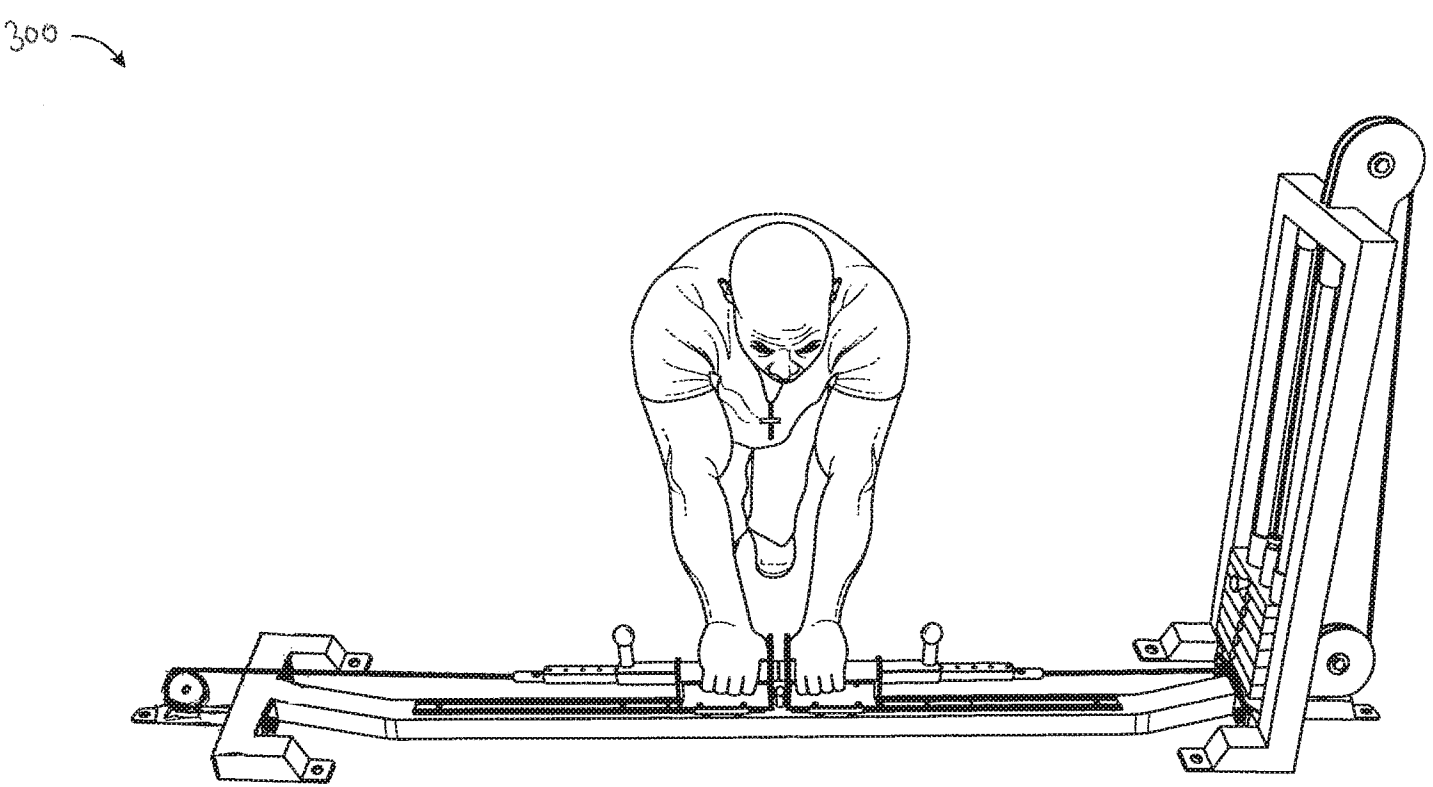
FIG. 9E illustrates a perspective front view of weight stack pushup exercise machine having two handles coupled to a single vertical resistance unit via one or more pulleys and cables in accordance with a representative embodiment of the present invention.

In some embodiments, the present invention comprises a weight stack pushup exercise machine 300 having two handles coupled to a single vertical resistance unit via a system comprising one or more pulleys and cables, as shown in FIG. 9E. The vertical resistance unit may comprise any type or kind of resistance unit disclosed herein. In some instances, the vertical resistance unit comprises a weight stack unit. In other instances, the vertical resistance unit comprises at least one of a number of resistance bands, one or more power rods, a hydraulic resistance system, and a system of free-weights.

Exercise machine 10 may be used in an alternative orientation to exercise the biceps and triceps of the user. For example, to exercise the bicep, a desired number of weight stack plates is selected. The user kneels next to cross-member 20 such that the body of the user is parallel to the central axis of the length of cross-member 20. To exercise the bicep, the user orients their feet towards the weight stack unit 60 and grips the handle 42. The user positions their body such that their elbow is fully extended when gripping handle 42 in the starting or maximum outward position. The user then flexes their bicep to pulls handle 42 towards center stop 22, thereby contracting their bicep.

To exercise their triceps, the user orients their head towards the weight stack unit 60 and grips handle 42. The user positions their body such that their elbow is fully flexed when gripping handle 42 in the starting position. The user then extends their elbow to push handle 42 towards center stop 22, thereby contracting their triceps.

Exercise machine 10 may further be used to exercise the abdominal muscles of a user 400. First, a desired number of weight stack plates are selected. The user kneels over cross-member 20 with their head oriented towards weight stack unit 60. The user grips handle 42 with both hands and positions their body such that both elbows are fully extended and the user is bent at the waist when handle 42 is in the starting position. The user then pulls handle 42 towards center stop 22 while simultaneously contracting the user's abdominal muscles in an upward direction to curl and contract the abdomen. Alternatively, in embodiments where the platform includes a loop 1002, these exercises can be performed by connecting a separate handle to loop 1002 and gripping the separate handle rather than handle 42.

Although exercise machine 10 has been described as employing weight stack unit 60 to provide resistance, other types of resistance units could be employed in place of weight stack unit 60 (generally "vertical resistance unit"). For example, rather than including weight stack plates 80, unit 60 could include a number of resistance bands, or power rods that can be selectively attached to cable 68 to vary the amount of resistance. In some instances, weight stack plates 80 are replaced with a hydraulic resistance system. In other embodiments, weight stack plates 80 are replaced with a system of free-weights.

The present invention may be embodied in other specific forms without departing from its structures, methods, or other essential characteristics as broadly described herein and claimed hereinafter. The described embodiments are to be considered in all respects only as illustrative, and not restrictive. The scope of the invention is, therefore, indicated by the appended claims, rather than by the foregoing description. All changes that come within the meaning and range of equivalency of the claims are to be embraced within their scope.

What is claimed is:

1. An exercise machine, comprising:

a cross-member having a center point, a first distal end, and a second distal end opposite the first distal end, the cross-member having coupled thereto a first platform on a first distal end side of the center point and a second platform on a second distal end side of the center point, the first and second platform each being configured to slide along the cross-member between an inner position that is towards the center point and an outer position that is towards the corresponding distal end, said cross-member further comprising a center stop positioned at the center point, the center stop limiting an inward movement of the first and second platforms; and a vertical resistance unit coupled to the first distal end of the cross-member, the vertical resistance unit being operably connected to the first and second platforms via a system of pulleys and a cable, wherein the vertical resistance unit provides resistance as at least one of the first and second platforms are slid from the outer position to the inner position, wherein the vertical resistance unit is a weight stack unit having weight stack plates that are lifted when the first or second platforms are slid from the outward position to the inward position.

2. The exercise machine of claim 1, wherein the cross-member includes a first outer stop positioned at the first distal end and a second outer stop positioned at the second distal end, the first and second outer stops limiting the outward movement of the first and second platforms respectively.

3. The exercise machine of claim 1, wherein the cross-member includes a first track to which the first platform is coupled and a second track to which the second platform is coupled.

4. The exercise machine of claim 1, wherein the cross-member includes a channel within which the first and second platforms are coupled.

5. The exercise machine of claim 1, wherein the first and second platforms each include a handle.

6. The exercise machine of claim 1, wherein each platform comprises an adjustment plate and a housing that is slidably coupled to the adjustment plate.

7. The exercise machine of claim 6, wherein the housing is configured to be coupled to the adjustment plate in multiple different positions thereby allowing the outer position of the corresponding platform to be adjusted.

8. The exercise machine of claim 1, further comprising:

a first mount formed at each of the first distal end and the second distal end;

a second mount formed on each of the first platform and the second platform;

a first resistance band coupled between the first mount formed at the first distal end and the second mount formed on the first platform; and a second resistance band coupled between the first mount formed at the second distal end and the second mount formed on the second platform.

9. The exercise machine of claim 8, wherein the first and second mounts are positioned to cause the resistance bands to be contained within the cross-member.

10. The exercise machine of claim 1, wherein the system of pulleys of the resistance unit includes a first pulley coupled to the vertical resistance unit in a manner that allows the first pulley to swivel, and wherein the cable is coupled to the vertical resistance unit and is detachable from the corresponding platform.

11. The exercise machine of claim 10, wherein the first pulley is located at a bottom of the vertical resistance unit.

12. The exercise machine of claim 1, wherein the vertical resistance unit is positioned at an angle, other than a ninety degree angle, with respect to the cross-member.

13. The exercise machine of claim 5, wherein the handle of the first and second platforms is centered overtop the cross-member.

14. The exercise machine of claim 1, wherein each platform includes an adjustment plate and a housing that slides overtop the adjustment plate to allow the platform to be positioned in a number of different outer positions, the housing containing a spring that is coupled to the adjustment plate to facilitate sliding the housing overtop the adjustment plate.

15. The exercise machine of claim 1, wherein at least one of the platforms includes a loop to which a handle can be coupled.

16. An exercise machine comprising:

a cross-member having a center point, a first distal end, and a second distal end;

a weight stack unit coupled to the first distal end, the weight stack unit including a plurality of weight stack plates;

a first platform coupled to the cross-member on a first distal end side of the center point, the first platform being configured to slide along the cross-member, the first platform being coupled to the weight stack unit such that movement of the first platform towards the center point of the cross-member causes at least one of the plurality of weight stack plates to be lifted to provide resistance to the movement;

a second platform coupled to the cross-member on a second distal end side of the center point, the second platform being configured to slide along the cross-member, the second platform being coupled to the weight stack unit such that movement of the second platform towards the center point of the cross-member causes at least one of the plurality of weight stack plates to be lifted to provide resistance to the movement; and a center stop positioned at the center point and configured to limit an inward movement of the first and second platforms.

17. An exercise machine comprising:

a cross-member having a center point, a first distal end, and a second distal end, the cross-member including a channel that extends along a length of the cross-member;

a first platform coupled within the channel on a first distal end side of the center point, and configured to slide within the channel from a first outward position towards the first distal end and a first inward position towards the center point;

a second platform coupled within the channel on a second distal end side of the center point, and configured to slide within the channel from a second outward position towards the second distal end and a second inward position towards the center point;

a vertical resistance unit coupled to the first distal end, the vertical resistance unit comprising a top pulley coupled to a top portion of the vertical resistance unit, a first bottom pulley coupled to a bottom portion of the vertical resistance unit, and a second bottom pulley coupled to the second distal end of the cross-member, the vertical resistance unit containing a source of resistance, the vertical resistance unit further comprising a cable having a first end coupled to the source of resistance, a second end coupled to the first platform, and a third end coupled to the second platform, such that inward movement of the first or second platforms causes the source of resistance to be lifted.

* * * * *